US008226421B2

(12) United States Patent
Umehara

(10) Patent No.: US 8,226,421 B2
(45) Date of Patent: Jul. 24, 2012

(54) ELECTRICAL CONNECTOR WITH TERMINALS JOINING BOARD TERMINALS

(75) Inventor: Hirokazu Umehara, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 13/091,654

(22) Filed: Apr. 21, 2011

(65) Prior Publication Data

US 2011/0263155 A1 Oct. 27, 2011

(30) Foreign Application Priority Data

Apr. 27, 2010 (JP) ..... 2010-101915

(51) Int. Cl.
*H01R 12/00* (2006.01)

(52) U.S. Cl. ..... 439/66

(58) Field of Classification Search ..... 439/66, 439/83, 60, 73, 586
See application file for complete search history.

(56) References Cited

U.S. PATENT DOCUMENTS 3,652,899 A * 3/1972 Henschen ..... 361/796
4,008,938 A * 2/1977 Anhalt et al. ..... 439/586
4,682,829 A * 7/1987 Kunkle et al. ..... 439/83
6,994,566 B2 * 2/2006 You ..... 439/66
8,118,607 B2 * 2/2012 Zhao et al. ..... 439/136
2008/0045045 A1 * 2/2008 Hung et al. ..... 439/66
2010/0317205 A1 * 12/2010 Zhao et al. ..... 439/136

FOREIGN PATENT DOCUMENTS

JP 2010-033953 A 2/2010

* cited by examiner

*Primary Examiner* — Chandrika Prasad
(74) *Attorney, Agent, or Firm* — Kubotera & Associates, LLC

(57) ABSTRACT

A joining electrical connector connects board electrical connectors in a connector fitting direction. The joining electrical connector has a housing and a plurality of terminals arranged in the housing in a terminal arrangement direction. Each joining terminal has a main body section with contact sections to connect to each terminal of the board electrical connectors and a supported section supported by the housing in the connector fitting direction. The main body section and the supported section can move in the terminal arrangement direction responding to displacement when the relative positions of the two board electrical connectors are displaced from the regular positions. The supported section is provided so as to have at least a part thereof in the connector fitting direction overlapped with the range of the main body section in the direction.

7 Claims, 13 Drawing Sheets

ELECTRICAL CONNECTOR WITH TERMINALS JOINING BOARD TERMINALS

BACKGROUND OF THE INVENTION AND RELATED ART STATEMENT

The present invention relates to a joining electrical connector for joining board electrical connectors, which are respectively disposed on electrical boards, with a connector fitting direction being perpendicular to board surfaces.

A conventional joining electrical connector is disclosed in, for example, Patent Reference. The conventional joining electrical connector disclosed in Patent Reference includes a housing having a first support member and a second support member; and a plurality of joining terminals that are arranged in and supported by the housing and connect the first support member and the second support member.

Patent Reference: Japanese Patent Application Publication No. 2010-033953

In the conventional joining electrical connector disclosed in Patent Reference, each joining terminal extends in a connector fitting direction (an up-and-down direction) and has two legs to connect with the respective board electrical connectors and a joining section for connecting the two legs. Each of the two legs extends in an axial direction that is downward from a lower part of the joining section, penetrates holes of the first support member and the second support member from thereabove, and has an upper end section supported by an inner circumferential surface so as to be able to pivotally move around the axis. Each leg has an annular groove formed at a portion that protrudes downward from the hole, and the annular groove works as a contact section to contact with a terminal of the board electrical connector.

In the conventional joining electrical connector with the configuration described above, when the respective board electrical connectors are arranged off from a regular position in the terminal arrangement direction, responding to the displacement, it is possible to displace the positions of the first support member and the second support member of the housing in the terminal arrangement direction, so that the conventional joining electrical connector can fit to each board electrical connector.

In addition, in the conventional joining electrical connector, when the first support member and the second support member displace in the terminal arrangement direction, the connecting terminals pivotally move around the axis while having the both legs, which are the contact sections, slidably contact in the circumferential direction with terminals of the board electrical connector at the annular groove, and thereby the joining section tilts when viewed from thereabove.

As described above, in the conventional joining electrical connector disclosed Patent Reference, the two legs of the joining terminal extend downward from the lower part of the joining section. Accordingly, the dimension of the joining terminal in the up-and-down direction (height dimension) is not smaller than a total height of the legs and the joining section, so that it is difficult to make the conventional joining electrical connector with a lower profile.

In view of the problems described above, an object of the invention is to provide a joining electrical connector with a smaller dimension in a connector fitting direction.

Further objects and advantages of the invention will be apparent from the following description of the invention.

SUMMARY OF THE INVENTION

In order to attain the objects described above, according to an aspect of the present invention, a joining electrical connector connects board electrical connectors, which are respectively disposed on two circuit boards, in a connector fitting direction being vertical to a surface of the circuit board.

According to the aspect of the present invention, the joining electrical connector has a housing and a plurality of terminals. The terminals extend in a joining direction to join the board electrical connectors, and are arranged in and supported by the housing in a terminal arrangement direction being vertical to both the joining direction and the connector fitting direction.

According to the aspect of the present invention, each joining terminal has a main body section, which extends in the joining direction and has contact sections to connect to each terminal of the two board electrical connector at the positions near the both ends in the joining section; and a supported section, which is provided at a position different from the contact section in the joining direction and supported by the housing in the connector fitting direction. The main body section and the supported section can move in the terminal arrangement direction responding to displacement when the relative positions of the two board electrical connectors are displaced from the regular positions. The supported section is provided so as to have at least a part thereof in the connector fitting direction overlapped with the range of the main body section in the direction.

According to the aspect of the present invention, the supported section is provided to have at least a part thereof in the connector fitting direction overlapped with a range of the main body section in the direction. Therefore, it is possible to reduce a size of the joining electrical terminal in the connector fitting direction for an amount of the overlap and thereby it is possible to attain a lower profile of the joining electrical connector.

According to the aspect of the present invention, each supported section of the joining terminals may be formed so as to protrude in the connector fitting direction, and supported while contacting with the housing in the connector fitting direction. Since the supported section is supported in a state that is almost a point contact by the housing, the support area is small, so that the friction between the supported section and the housing is small. Therefore, when the joining terminal moves in the terminal arrangement direction responding to the displacement in the relative positions of the board electrical connectors, it is possible to smoothly respond to the displacement of the board electrical connectors.

According to the aspect of the present invention, the supported sections of the joining terminal may be provided at extending sections that extend from the both ends of the main body section in the joining direction, and the housing has a hole to house the extending section and has a support section to support the supported section with an inner wall surface of the hole.

According to the aspect of the present invention, the housing may have a first support member to support the supported section, which is provided at one end of the joining terminal in the joining direction, and a second support member to support the supported section, which is provided at the other end. One of the first support member and the second member has a latching protrusion as a protrusion, and the other has a latching hole as a hole for the latching protrusion to latch therein in the joining direction.

In the joining direction, the first support member and the second support member are joined by latching between the latching protrusion and the latching hole, and there is a gap formed between the both edges of the latching hole and the latching protrusion in the terminal arrangement direction, so that the first support member and the second support member can move relative to each other in the terminal arrangement direction within the range of the gap.

As describe above, the first support member and the second support member can move relative to each other in the terminal arrangement direction within the range of the gap. Accordingly, the main body section and the supported section of each joining terminal can move responding to the displacement of the board electrical connectors. Furthermore, according to the invention, the first support member and the second support member can move relative to each other. Accordingly, there is no elastic deformation generated between the first support member and the second support member. Therefore, there is no reaction force due to the elastic deformation, and the main body section and the supported section of the joining terminal can move with less resistance.

As described above, according to the invention, the supported section of the joining terminal is provided to have at least a part thereof overlapped within the range of the main body section in the connector fitting direction. Accordingly, it is possible to reduce the profile of the joining terminal and in turn the profile of the joining electrical connector in the connector fitting direction.

DETAILED DESCRIPTION OF PREFERRED EMBODIMENTS

Hereunder, referring to the accompanying drawings, embodiments of the invention will be described.

First Embodiment

Figure 1:
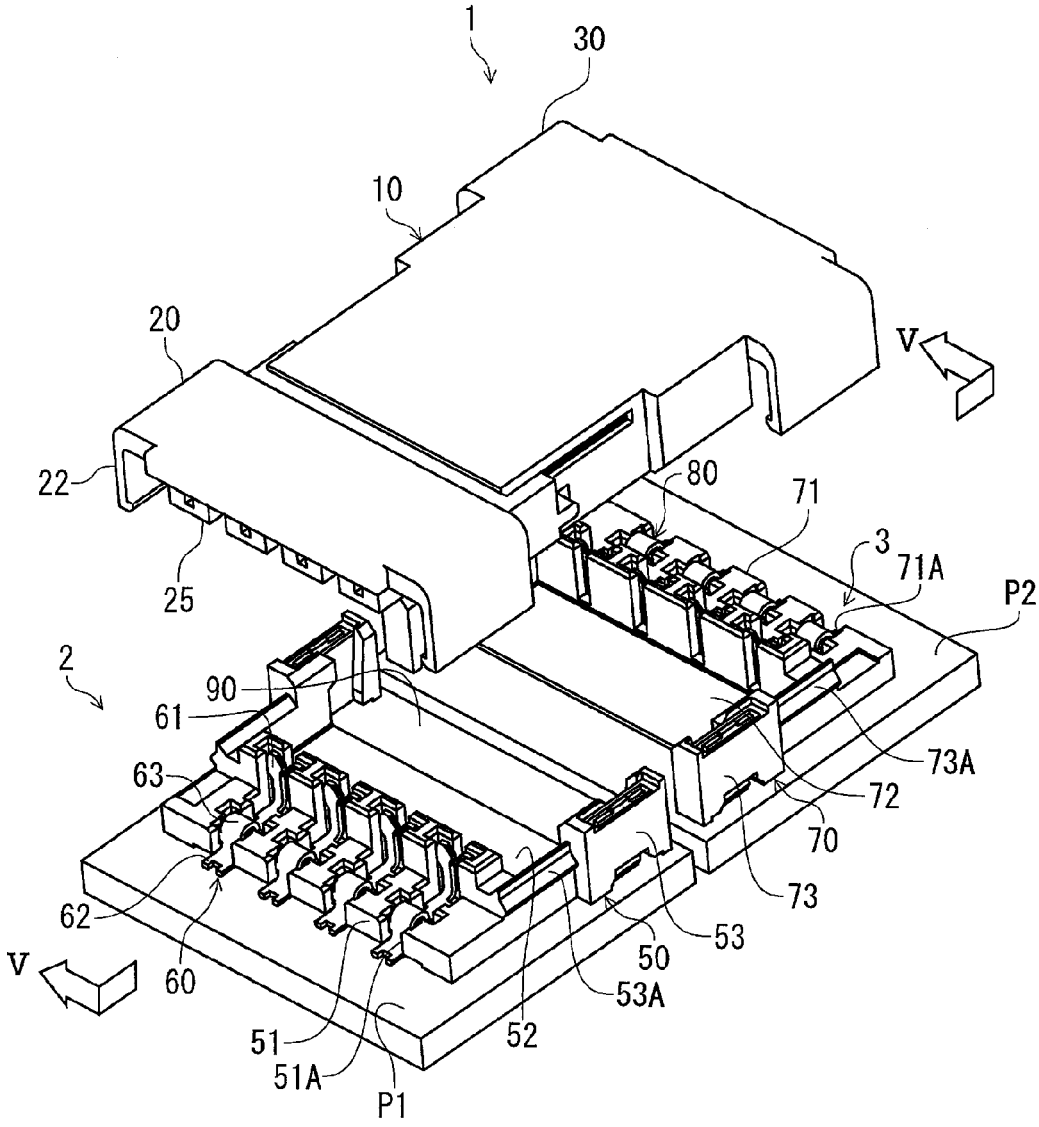
FIG. 1 is a perspective view showing a joining electrical connector and board electrical connectors according to a first embodiment of the present invention.
Figure 2:
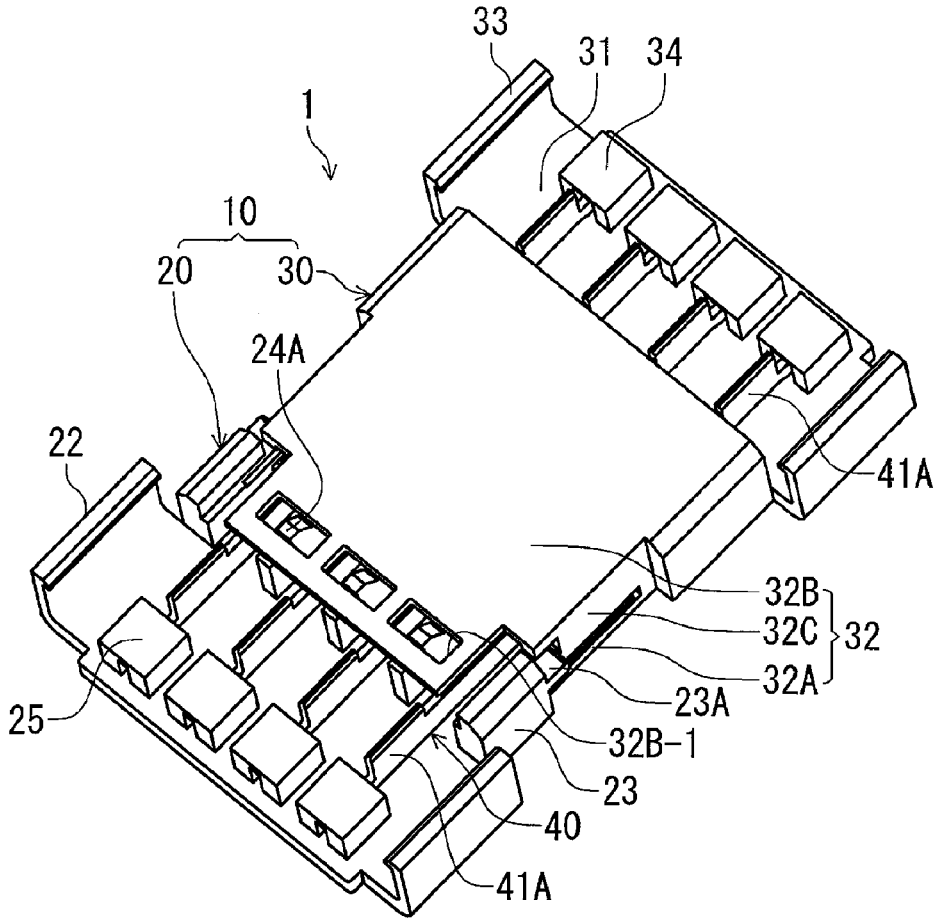
FIG. 2 is a perspective view showing the joining electrical connector viewed from a bottom side according to the first embodiment of the present invention.

FIG. 1 is a perspective view of a joining electrical connector and board electrical connectors in the embodiment, and shows a state that is viewed from thereabove when the connectors are separated from each other. In addition, FIG. 2 is a perspective view of the joining electrical connector of FIG. 1, which is viewed from therebelow. A joining electrical connector 1 of the embodiment (hereinafter simply referred to as a joining connector 1) is fitted from thereabove to connect to the mating connectors, i.e. board electrical connectors 2 and 3 (hereinafter referred to as a board connector 2 and a board connector 3, respectively), which are respectively mounted on circuit boards P1 and P2 provided so as to have their edges face to each other on the same surface, and thereby connect the board connectors 2 and 3.

The joining connector 1 has a housing 10 that has a shape of a generally rectangular prism and is made of synthetic resin; and a plurality of joining terminals 40 (see FIG. 2) that extend in a joining direction (a left-and-right direction in FIG. 1) to join the board connectors 2 and 3, are arranged in and supported by the housing 10, and are made from sheet metal. The housing 10 has a first support member 20 to support one end side (a left side in FIG. 1) of the joining terminals 40 in the joining direction; and a second support member 30 to support the other end side (a right side in FIG. 1).

As will be described later, the first support member 20 and the second support member 30 form the housing 10 by latching to join in the joining direction. Hereunder, for the sake of simplifying the description, the first support member 20 and the second support member 30 may be also collectively referred to as support members 20 and 30.

Figure 3:
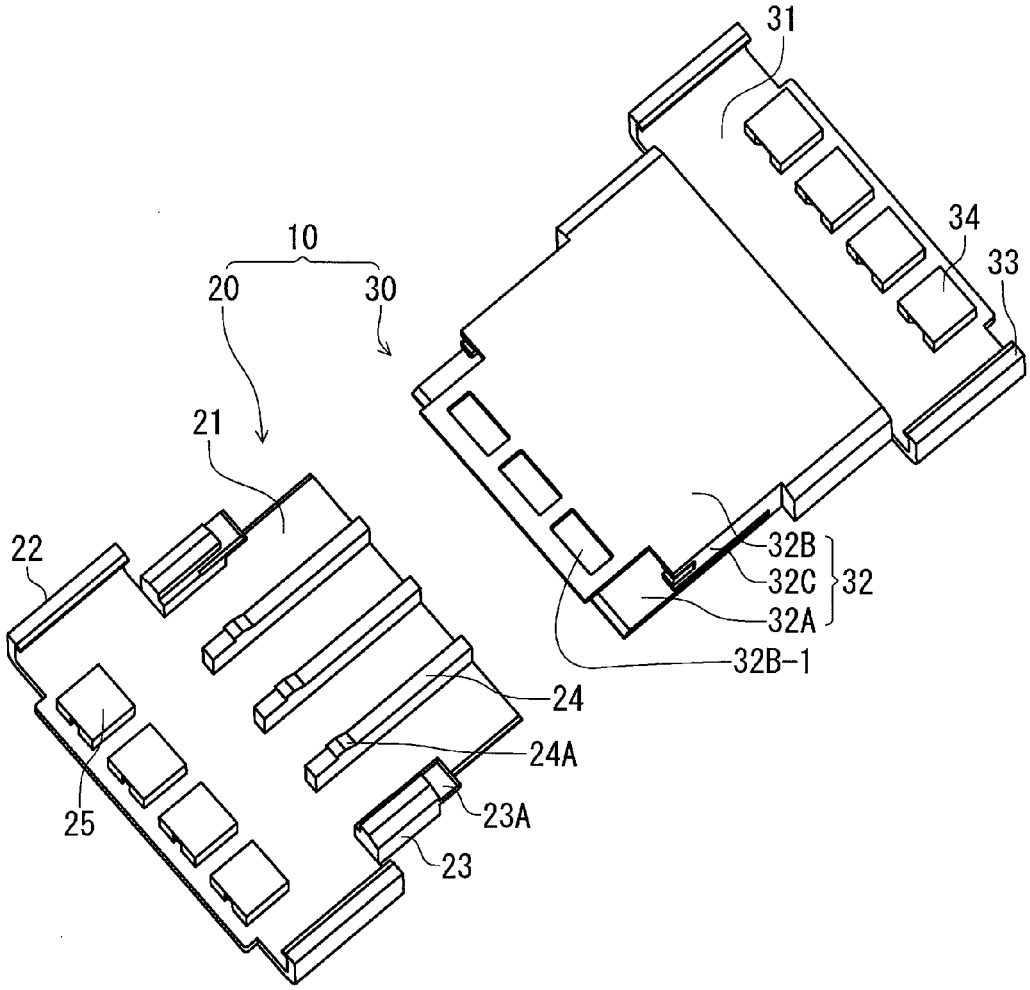
FIG. 3 is an exploded perspective view showing the joining electrical connector according to the first embodiment of the present invention.

FIG. 3 is a perspective view of the housing 10 of the joining connector 1 of FIG. 2, in which the first support member 20 and the second support member 30 are separated. The first support member 20 has a flat section 21 having a plate surface vertical to the connector fitting direction; a pair of locking sections 22 provided at positions near the left end of the both edges that extend in the joining direction (a left-and-right direction in FIG. 3) of the flat section 21; side walls 23 provided at generally center of the both edges of the flat section 21; a plurality of thin protrusions 24 that protrude upward in FIG. 3 from the plate surface of the flat section 21 and extend towards the right end side from the generally center part in the joining direction; and a plurality of support sections 25 that protrude upward in FIG. 3 being close to the left end of the plate surface of the flat section 21 and support protrusions to be supported 42A of the joining terminals 40, which will be described later. The plurality of the support section 25 is provided corresponding to positions of the joining terminals 40 in the terminal arrangement direction.

As shown in FIG. 3, the pair of locking section 22 is vertically bent upward from the both edges of the flat section 21, and has a claw section formed to protrude so as to be close to each other at the upper end. Each locking section 22 locks into a section to be locked of the board connector 2, which will be described later, in the connector fitting direction, so that it is possible to prevent the connectors' coming off from the fitting.

Each of the pair of side walls 23 has a protruding flat section 23A, which extends rightward in FIG. 3 and has a plate surface that is parallel to a surface of the flat section 21. The thin protrusions 24 are arranged at equal intervals in a terminal arrangement direction, i.e. a direction vertical to both the connector fitting direction, and the joining direction, being close to the second support member 30 at a plate surface of the flat section 21, i.e. in a right half area in FIG. 3, and provided between adjacent joining terminals 40. Each thin protrusion 24 has near the left end a latching protrusion 24A that is formed to protrude upward in FIG. 3 for latching with the latching hole 32B-1 of the second support member 30, which will be described later, in the joining direction. As shown in FIG. 2, the joining terminals 40 are arranged between the thin protrusions 24 in the terminal arrangement direction and between the thin protrusions 24 and the side walls 23, being parallel to the thin protrusions 24.

Each support section 25 has a shape of generally rectangular prism and has a hole that penetrates in the joining direction. An extending section 42 of each joining terminal 40, which will be described later, is held in the hole and an inner wall surfaces of each hole support a protrusion to be supported 42A of each extending section 42 (see FIG. 5). As shown in FIG. 2, the support sections 25 are provided at the same positions as the joining terminals 40. More specifically, as well shown in FIG. 3, the support sections 25 are provided between the adjacent thin protrusions 24 or between the thin protrusions 24 and the side walls 23.

The second support member 30 has a flat section 31, which has a plate surface that is vertical to the connector fitting direction; a frame-like housing section 32 to house a right half part of the first support member 20; a pair of locking sections 33, which is provided on the right end side of the second support member 30 and latches onto a section to be locked 73A of the board connector 3, which will be described later; and a plurality of support sections 34, which are provided on the right end side and support supported sections 42A of the joining terminals 40. Since the locking section 33 and the support section 34 have the same shapes as those of the locking sections 22 and the support sections 25 of the above-described first support member 20 and are arranged symmetrically with respect to the locking sections 22 and the support sections 25 in the joining direction, the explanation will be omitted.

The housing section 32 is formed to have a frame-like shape being surrounded by an upper wall 32 and a lower wall 32B, which extend in directions vertical to the connector fitting direction while being parallel to each other, and a pair of side walls 32C provided at the both edges in the terminal arrangement direction. FIG. 3 shows the second support member 30 viewed from the bottom side, so that it is upside down in comparison with FIG. 1; the lower wall 32B is shown on the upper wall 32A and the lower wall 32B is shown on the lower side in FIG. 3.

The upper wall 32A is a part of the flat section 31 and forms a generally left half part of the flat section 31. Near left end of the lower wall 32B, there are window-like latching holes 32B-1, which house the latching protrusions 24A of the thin protrusions 24 of the first support member 20 and latch in the joining direction. The latching holes 32B-1 are formed to be arranged at the same positions as the latching protrusions 24A in the terminal arrangement direction, and form window-like rectangular holes, each of which extends with larger width than the latching protrusion 24A in the terminal arrangement direction and penetrates in the connector fitting direction.

As shown in FIG. 2, the latching protrusions 24A of the first support member 20 are housed in the latching holes 32B-1 of the second support member, and the latching protrusions 24A and the latching holes 32B-1 latch to each other in the joining direction, and thereby the first support member 20 and the second support member 30 are joined in the direction. In addition, while the latching protrusions 24A latch into the latching holes 32B-1, there are gaps formed between the both edges of the latching holes 32B-1 and the latching protrusions 24A in the terminal arrangement direction. As will be described, the first support member 20 and the second support member 30 can move relative to each other in the terminal arrangement direction within the gap.

Figure 4:
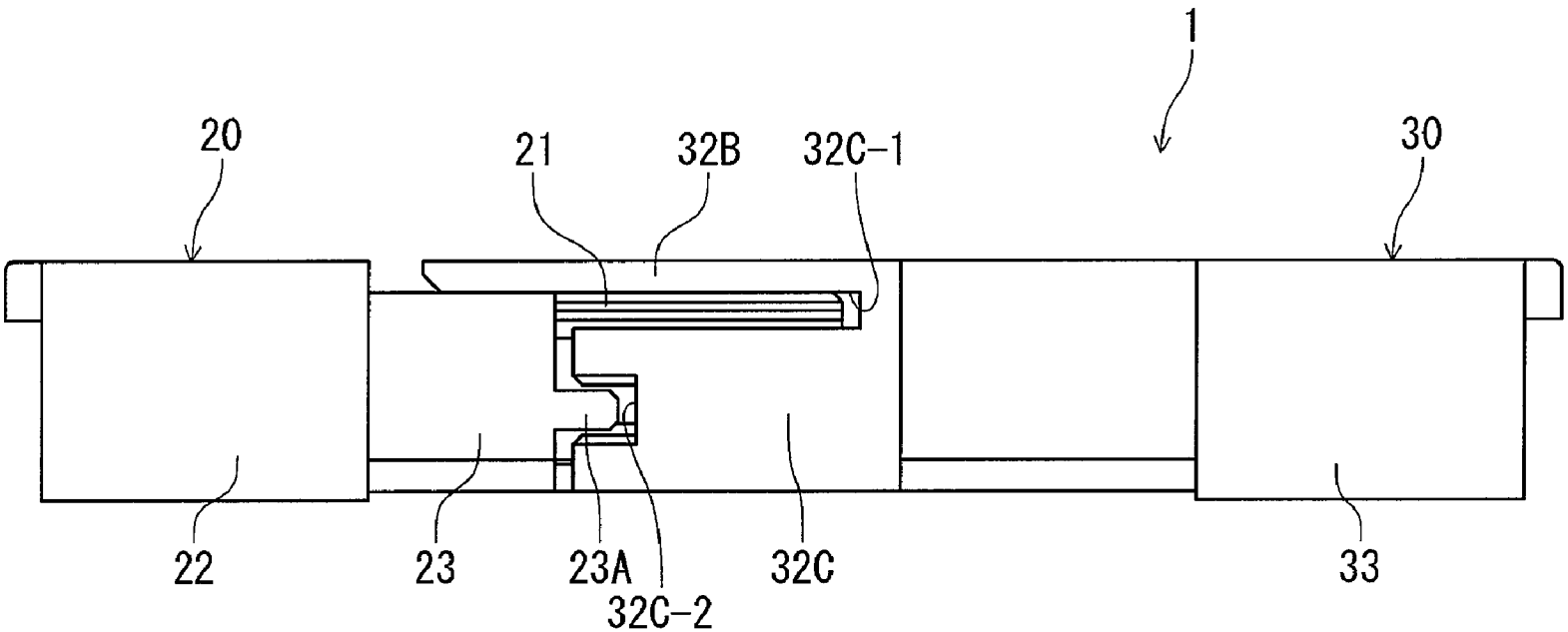
FIG. 4 is a side view showing the joining electrical connector according to the first embodiment of the present invention.

FIG. 4 is a side view of the joining connector 1 of FIG. 1, which is viewed in the terminal arrangement direction. As well shown in FIG. 4, each side wall 32C of the second support member 30 has a slit-like upper groove 32C-1 and a lower groove 32C-2, which are open leftward and penetrate in the terminal arrangement direction (an vertical direction to the paper surface), formed near the upper end and at generally center position in the connector fitting direction (an up-and-down direction in FIG. 4), respectively. Each upper groove 32C-1 extends further right than the lower groove 32C-2, and has a slightly larger width than the thickness of the flat section 21 of the first support member 20 so as to be able to receive the flat section 21. Furthermore, each lower groove 32C-2 is formed to have a slightly larger groove width than that of the projecting flat section 23A of the first support member 20 and can receive the projecting flat section 23A.

Figure 5:
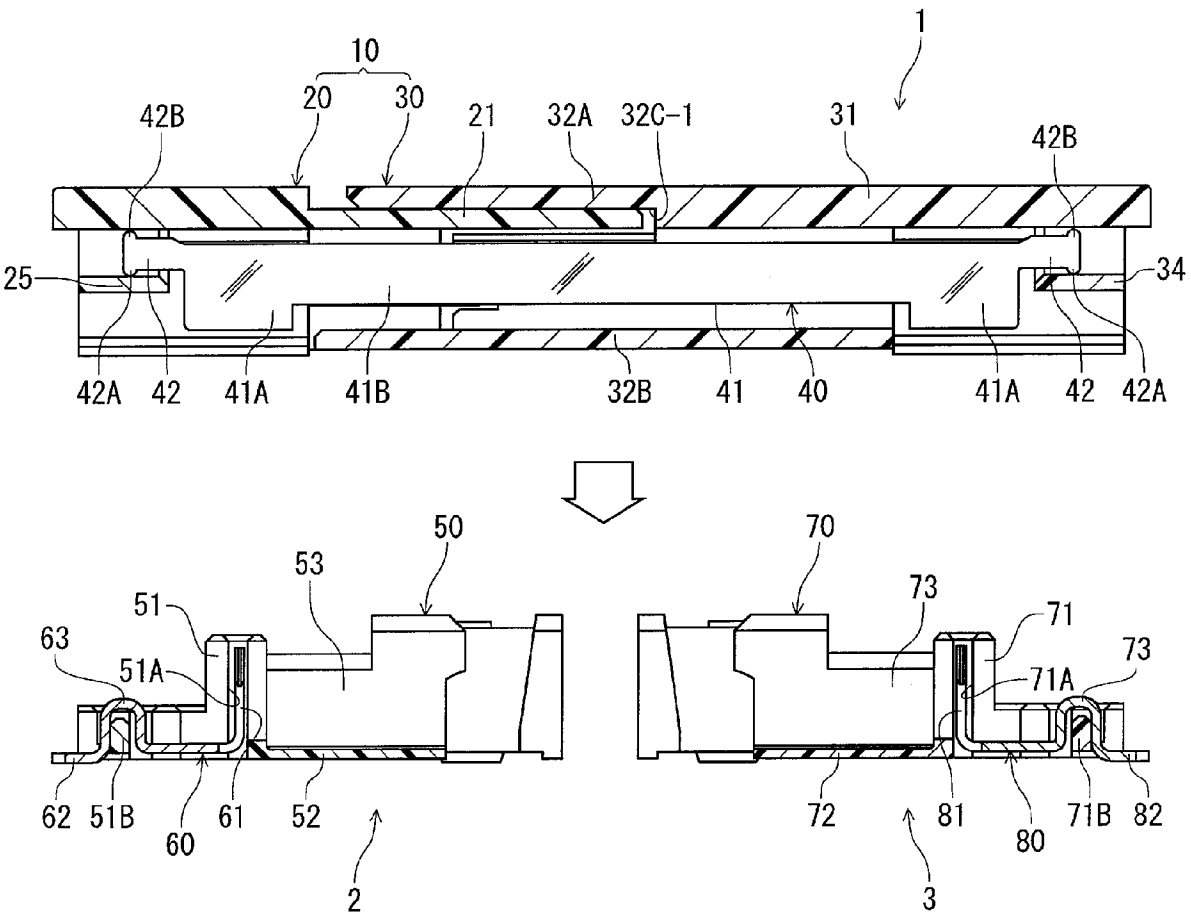
FIG. 5 is a longitudinal sectional view showing the joining electrical connector and the board electrical connectors before fitting the connectors along a line V-V in FIG. 1 according to the first embodiment of the present invention.

FIG. 5 is a V-V sectional view of FIG. 1, and shows longitudinal sections of the joining connector 1 and the board connectors 2 and 3 before the connector fitting at the position of the joining terminal 40 in the terminal arrangement direction. Each joining terminals 40 is made by punching sheet metal while keeping its plate surface and arranged having its plate surface parallel to the paper surface with the terminal arrangement direction being vertical to the paper surface.

Each joining terminal 40 has a wide flat main body section 41 that extends in the joining direction (a left-and-right direction in FIG. 5) and extending sections 42 that extend in the joining direction from a position near the upper ends of the both end sections of the main body 41 in the joining direction. Each joining terminal 40 joins the support members 20 and 30 by having the both ends in the joining direction supported by the support members 20 and 30.

The main body section 41 of each joining terminal 40 has a contact section 41A to respectively connect to a terminal (mating terminal 60 that will be described later) of the board connectors 2 and 3 at positions near the both ends in the joining direction, and the contact sections 41A are joined to each other by the joining section 41B that extends in the joining direction. The contact section 41A is formed to have a larger dimension in the connector fitting direction than that of the joining section 41B.

In addition, it is not essential to form the contact section 41A larger than the joining section 41B in the up-and-down direction, and for example, it is possible to form the contact section 41 and the joining section 41B to have the same size in the up-and-down direction.

As shown in FIG. 5, each extending section 42 is provided so as to have a part thereof overlapped with the range of the main body section 41. Moreover, the extending sections 42 are housed in holes of the respective support sections 25 and 34 of the support members 20 and 30. In the terminal arrangement direction, there are slight gaps formed between the plate surfaces of the extending section 42 and inner wall surfaces of the holes, and thereby the extending sections 42 can move in the terminal arrangement direction within range of the respective gaps. Each extending sections 42 has a protrusion to be supported 42A as a semicircular protrusion that protrudes downward from a lower edge at an end in the joining direction and the protrusion to be supported 42A is supported by a lower wall of each support section 25 and 34.

As shown in FIG. 5, each protrusion to be supported 42A is provided to have an overlap in the connector fitting direction with the main body section 41 in the connector fitting direction. Therefore, it is possible to reduce the size of the joining terminal 40 in the connector fitting direction for the amount of the overlap and in turn it is possible to reduce the profile of the joining connector 1.

In addition, each extending section 42 has a restricting protrusion 42B as a semicircular protrusion that protrudes upwards from an upper edge at the same position as that of the protrusion to be supported 42A in the joining direction. As shown in FIG. 5, in a state that the protrusions to be supported 42A are supported by the support sections 25 and 34, there is a slights gap formed in the connector fitting direction between the restricting protrusions 42B and the flat sections 21 and 31.

As will be described later, when the joining terminals 40 are lifted due to friction from contact between the joining terminals 40 and the mating terminals 60, which occurs upon connector fitting, the restricting protrusions 42B contact with the flat sections 21 and 31, and thereby restrict upward movement of the joining terminals 40 for an amount more than a specific amount. Here, it is not essential to form the gaps between the restricting protrusions 42B and the flat sections 21 and 31 before the connector fitting, and for example, there is no problem if the restricting protrusions contact with the flat sections 21 and 31 before the connector fitting.

The joining connector 1 of the embodiment may be assembled as follows. First, one of the extending sections 42 of each joining terminal 40 is housed in a hole of a support section of one of the support member, the first support member 20, and the second support member 30. Then, a right half part (in FIG. 3) of the first support member 20 is housed in the housing section 32 of the second support member 30 by having the flat section 21 and the projecting flat section 23A of the first support member 20 enter the upper groove 32C-1 and the lower groove 32C-2 of the second support member 30, respectively.

Thereafter, housing the latching protrusion 24A of the first support member 20 in the latching hole 32B-1 of the second support member 30, the latching protrusion 24A and the latching hole 32B-1 are latched to each other in the joining direction. As a result, the first support member 20 and the second support member 30 are joined while being in a state of supporting the joining terminal 40, and thereby the assembly of the joining connector 1 is completed.

As well shown in FIG. 5, the flat section 21 of the first support member 20 has a portion housed in the upper groove 32C-1 of the second support member 30 positioned below the other portion for the thickness of the upper wall 32A of the second support member 30. Accordingly, in a state that the joining connector 1 is assembled, the upper surface of the first support member 20 and the upper surface of the second support member 30 are at the same position in the connector fitting direction (the up-and-down direction).

The board connector 2 and the board connector 3 have the same configuration, and as shown in FIGS. 1 and 5, those connectors are symmetrically disposed in the joining direction. Hereunder, the configuration of the board connector 2 will be described, and description of the configuration of the board connector 3 will be omitted by adding 20 to the reference numerals of the board connector 2.

The board connector 2 has a housing 50 made of synthetic resin and a plurality of terminals 60 that are arranged in and held by the housing 50. Hereunder, terminals 60 are referred to as mating terminals 60 to clearly distinguish from the joining terminals 40 of the joining connector 1.

As shown in FIG. 1, the housing 50 has a terminal holding wall 51 that extends in the terminal arrangement direction; a flat bottom wall 52 that extends from a lower part of the terminal holding wall 51 towards the board connector 3 side in the joining direction and in the terminal arrangement direction; and a pair of side walls 53 that extend from the both edges of the terminal holding wall 51 in the terminal arrangement direction and towards the board connector 3 side in the joining direction.

As well shown in FIG. 5, the terminal holding wall 51 has its generally upper portion of a generally left half portion notched, and has an inverse L-shaped section that is perpendicular to the terminal arrangement direction, which is an L-shape that is inversed in the joining direction (a left-and-right direction in FIG. 5). As shown in FIG. 1, the terminal holding wall 51 has terminal holding grooves 51A at equal intervals in the terminal arrangement direction for holding the mating terminals 60 corresponding to positions of the joining terminals 40.

As shown in FIG. 5, each terminal holding groove 51A extends along the terminal holding wall 51 forming an inverse L-shape for a sectional shape and connects to the inner groove wall surface that faces in the terminal arrangement direction an island-like section 51B formed like an island near a left end of a part extending in the left-and-right direction. Furthermore, a gap formed above the portion extending in the left-and-right direction can receive the support section 25 of the joining connector 1 in the connector fitting state (see FIG. 6).

As shown in FIGS. 1 and 5, the pair of the side walls 53 are formed to extend to be closer the board connector 3 side (the right side in FIG. 5) than the bottom wall 52. The pair of the side walls 53 have claw-like sections to be locked 53A that protrude from the upper ends of portions near the terminal holding wall 51 (left half portion in FIG. 5) being separated from each other in the terminal arrangement direction. The section to be locked 53A latches to the claw section of the locking section 22 of the joining connector 1 in the connector fitting state.

As shown in FIG. 1, the space surrounded by the terminal holding walls 51 and 71, the bottom walls 52 and 72, and the side walls 53 and 73 of the board connectors 2 and 3 has receiving space 90 to receive the joining connector 1 from thereabove.

Each mating terminal 60 is made by punching sheet metal and then bending in the thickness direction, and has a section having a generally inverse L-shape as in FIG. 5, and held in the terminal holding groove 51A. A portion of the mating terminal 60 at one end side, i.e. a portion extending in the up-and-down direction in FIG. 5, has a slit-like groove that extends in the up-and-down direction, and a pair of arms provided across the groove works as mating contact arms 61 for contacting with the joining terminals 40 after the grooves receive the joining terminals 40 of the joining connector 1 in the grooves from thereabove (see also FIG. 7).

Figure 7:
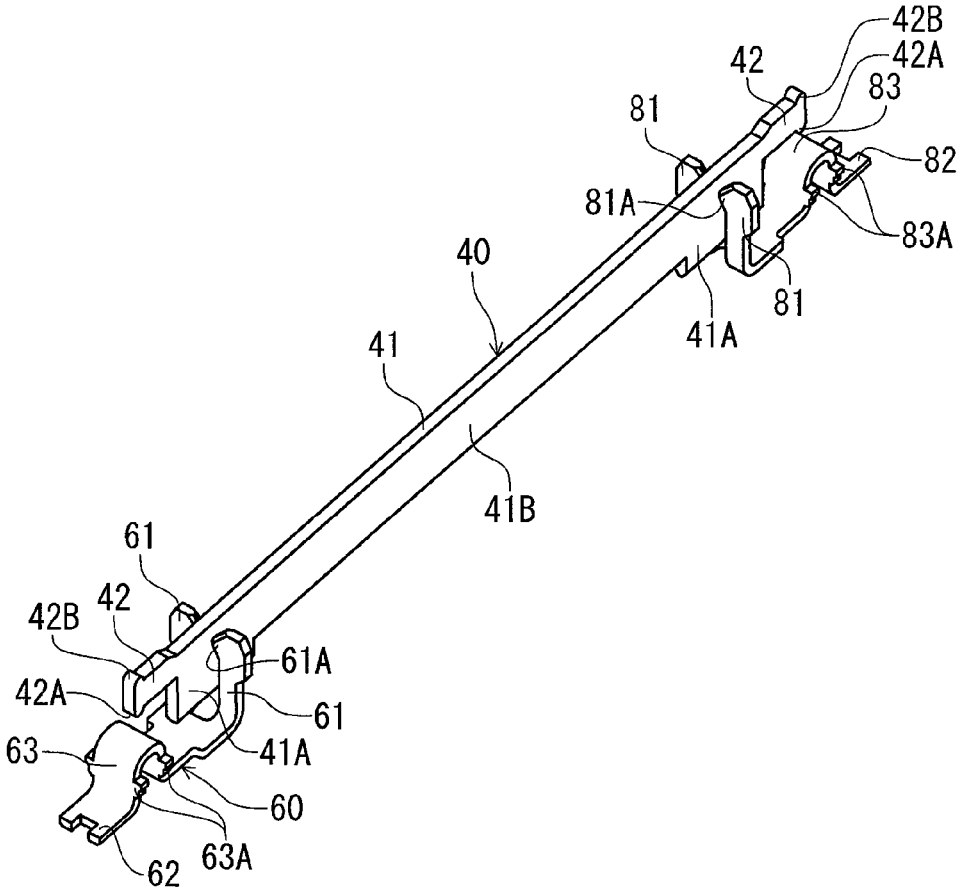
FIG. 7 is a perspective view showing the joining electrical connector and terminals of the board electrical connectors in the connector fitting state according to the first embodiment of the present invention.

The pair of mating contact arms 61 have mating contact protrusions 61A that protrude at the upper ends in a direction to get close to each other (see FIG. 7). In other words, the mating terminals 60 are configured to have point contact at the mating contact section 61A with a plate surface of the contact section 41A of the joining terminal 40.

A portion of the mating terminal 60 on the other end side, i.e. a portion on the left end side of a portion that extends in the left-and-right direction in FIG. 5 is formed as a connecting section 62 to connect to a corresponding circuit section (not illustrated) provided on the circuit board P1. Each connecting section 62 protrudes from the terminal holding wall 51 and is connected by soldering to the corresponding circuit section.

In addition, as well shown in FIG. 5, the mating terminal 60 has a section to be held 63 that is bent so as to project like an inverse U-shape near the left end, and the section to be held 63 has protrusions to be held 63A on the both side edges (see FIG. 7). The mating terminal 60 is pressed in the terminal holding groove 51A from thereabove, and the protrusion to be held 63A engages onto an inner wall surface of the terminal holding groove 51A and thereby held in the terminal holding groove 51A.

From now on, explanation is provided for fitting operation of the joining connector 1 with the board connectors 2 and 3 when the board connectors 2 and 3 are at the regular positions, which will be described below. In the embodiment, the regular position means a state in which the board connectors 2 and 3 are arranged at the same positions without displacements in the terminal arrangement direction (see FIG. 8).

First, the board connectors 2 and 3 are respectively attached to two circuit boards P1 and P2, which are disposed on the same plane with their edges facing to each other in the joining direction. Thereafter, as shown in FIG. 5, the joining connector 1 is disposed so that the contact sections 41A of the joining terminals 40 of the joining connector 1 is above the contact arms 61 of the mating terminals 60 of the board connectors 2 and 3, and as indicated with an arrow in FIG. 5, the joining connector 1 is fitted in the board connectors 2 and 3, respectively, from thereabove.

Figure 6:
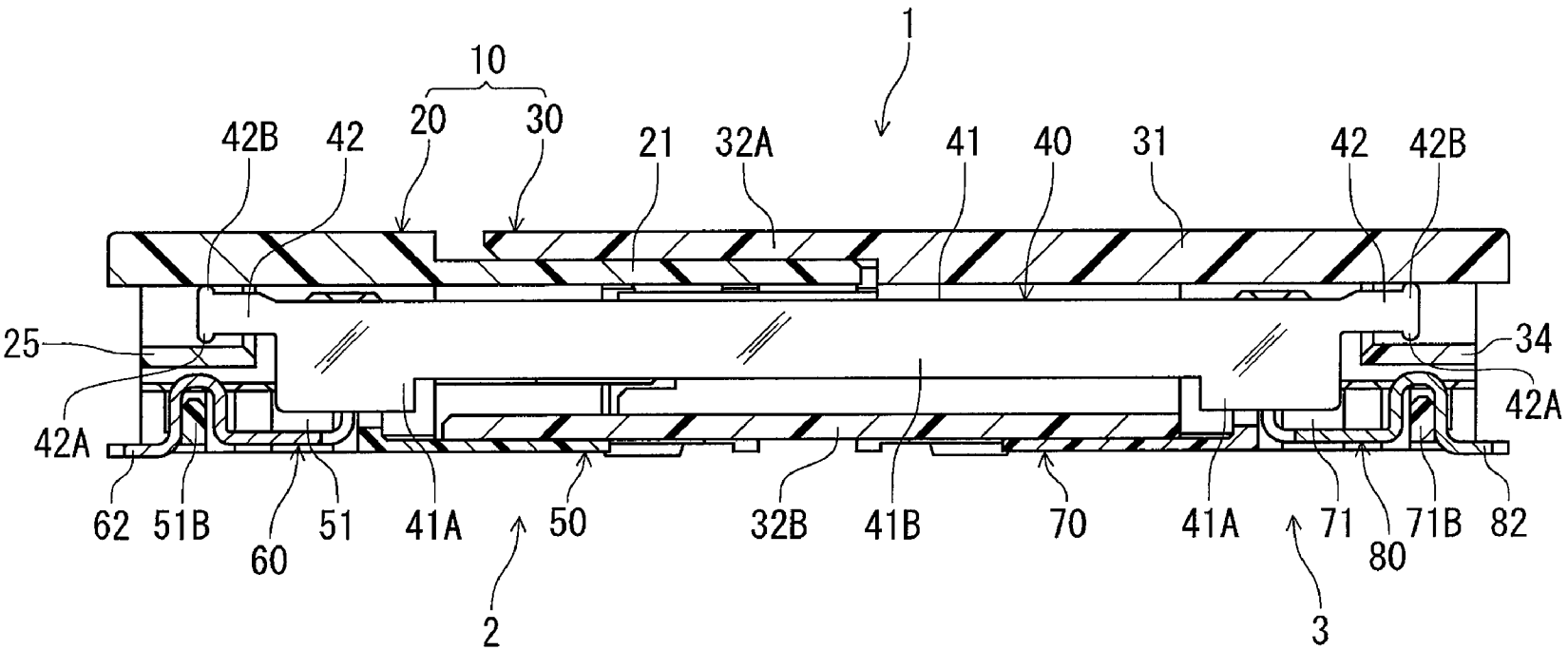
FIG. 6 is a longitudinal sectional view showing the joining electrical connector and the board electrical connectors in the connector fitting state according to the first embodiment of the present invention.
Figure 8:
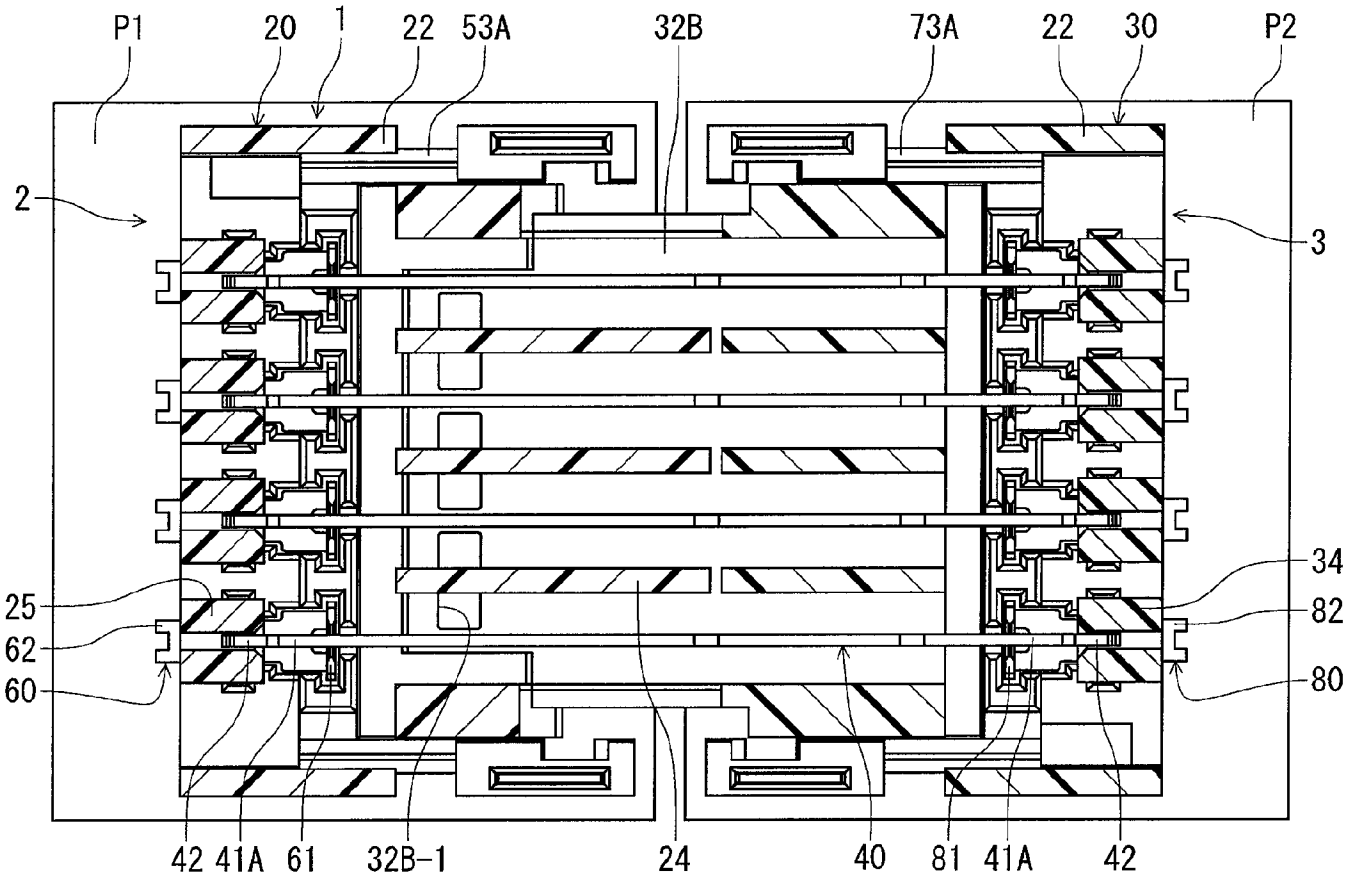
FIG. 8 is a lateral sectional view showing the joining electrical connector and the board electrical connectors in the connector fitting state, in which a first support member and a second support member are at regular positions according to the first embodiment of the present invention.

FIG. 6 is a longitudinal sectional view of the joining connector 1 and the board electrical connectors 2 and 3 in the connector fitting state. FIG. 7 is a perspective view of the joining terminal 40 of the joining connector 1 and mating terminals 60 and 80 of the board connectors 2 and 3, and is an extracted view showing only the joining terminal 40 and the mating terminals 60 and 80. FIG. 8 is a lateral sectional view of the joining connector 1 and board connectors 2 and 3 in the connector fitting state, when the board connectors 2 and 3 are at the regular positions, and shows a lateral section viewed from thereabove at the thin protrusions 24 of the joining connector 1 in the connector fitting direction.

As shown in FIG. 6, a portion that houses the joining sections 41B of the joining terminals 40 in the joining connector 1 is housed in the receiving space 90 (see FIG. 1), which is formed by the two board connectors 2 and 3, from thereabove. In addition, the support sections 25 and 34 of the joining connector 1 are brought right above a portion that extends in the joining direction (the left-and-right direction in FIG. 6) in the terminal holding walls 51 and 71.

As shown in FIG. 7, the two contact sections 41A of each joining terminal 40 enter the grooves between the mating contact arms 61 of the mating terminal 60 and between the mating contact arms 81 of the mating terminal 80. Each contact section 41A is tightly pressed at plate surfaces by the pair of the mating contact protrusions 61A and the pair of the mating contact protrusions 81A, and has point contact with contact pressure to the mating contact protrusions 61A and 81A.

When the contact sections 41A enter the grooves between the mating contact arms 61 and grooves between the mating contact arms 81, there is friction generated between the plate surfaces of the contact sections 41A and the mating contact protrusions 61A and 81A in the connector fitting direction (the up-and-down direction). Accordingly, prior to the connector fitting, the supported sections 42A of each joining terminal 40 contact with and is supported by the support sections 25 and 34 of the housing 10 as shown in FIG. 5, but when it is in a state of connector fitting, the joining terminal 40 lifts due to the friction as shown in FIG. 6, so that the restricting protrusion 42B of the joining terminal 40 contacts with the flat sections 21 and 31 of the housing 10 and thereby the joining terminal 40 is restricted from moving upward more than a certain amount.

The connector fitting operation is completed by latching the locking sections 22 and 33 of the joining connector 1 with the section to be locked 53A and 73A of the board connectors 2 and 3 in the up-and-down direction. As such, when the board connectors 2 and 3 are disposed at the regular positions, as shown in FIG. 8, the joining terminal 40 extends in the joining direction (in the left-and-right direction in FIG. 8) without tilting in the terminal arrangement direction (downward in FIG. 8), and the first support member 20 and the second support member 30 of the joining connector 1 are disposed at the regular positions without displacement in the terminal arrangement direction.

Figure 9:
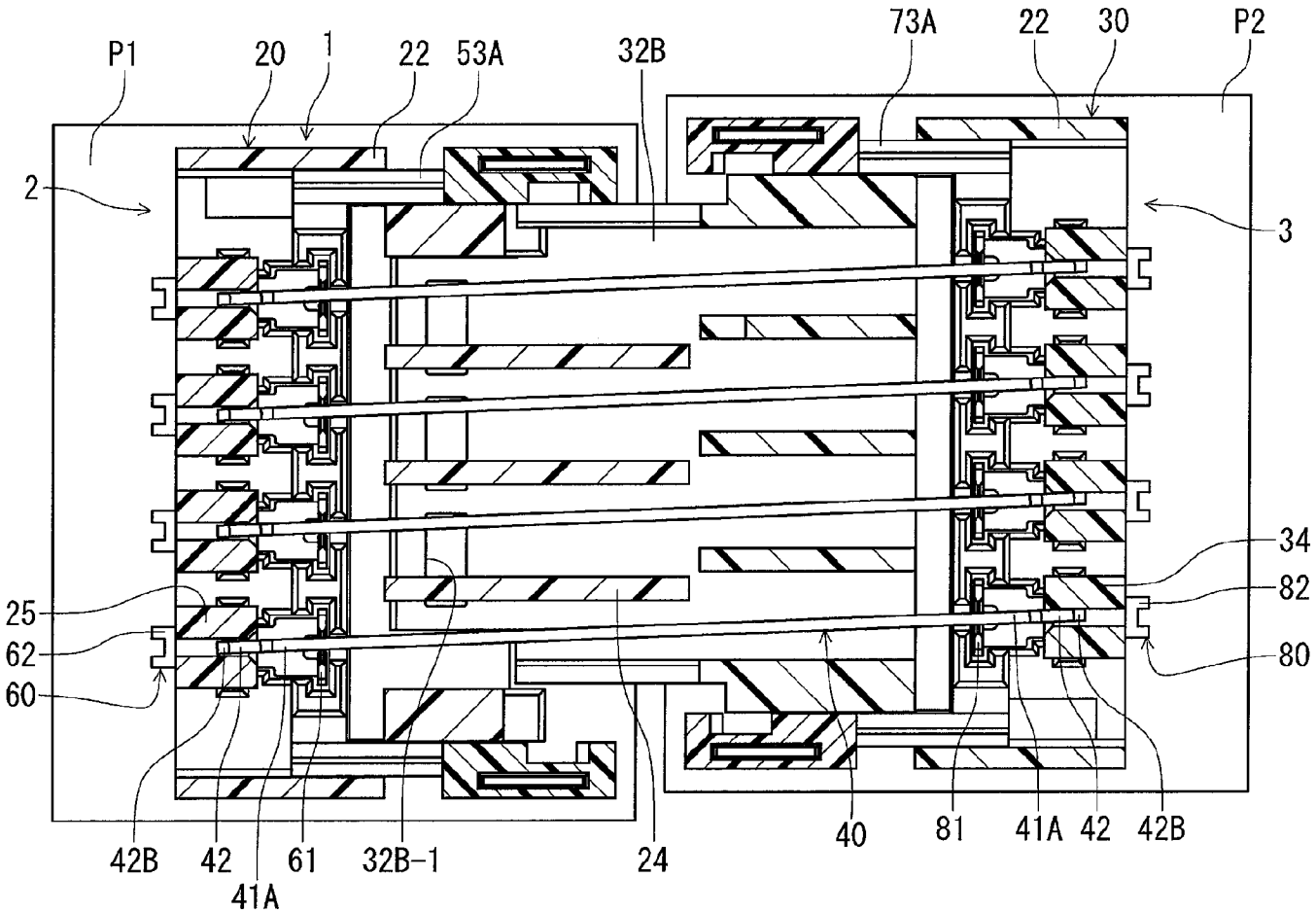
FIG. 9 is a lateral sectional view showing the joining electrical connector and the board electrical connectors in the connector fitting state, in which the first support member and the second support member are displaced from the regular positions according to the first embodiment of the present invention.
Figure 10:
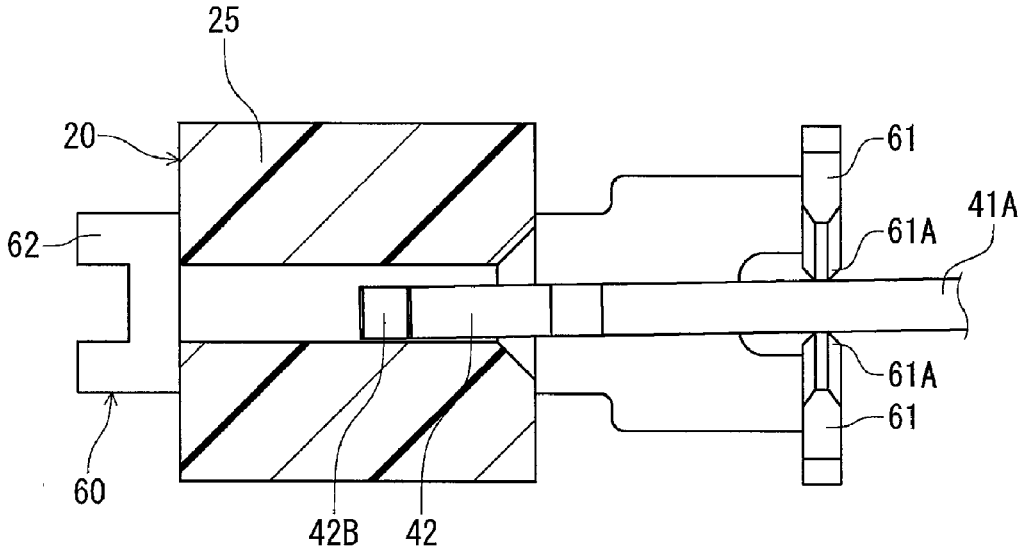
FIG. 10 is a partially enlarged view showing a peripheral portion of the joining terminal of the joining electrical connector on a left end side according to the first embodiment of the present invention.

Next, fitting operation of the joining connector 1 to the board connectors 2 and 3 when the board connectors 2 and 3 are displaced in the terminal arrangement direction will be described. FIG. 9 is a lateral sectional view of the joining connector 1 and the board connectors 2 and 3 in the connector fitting state, when the board connectors 2 and 3 are displaced from the regular positions, and shows a state when a lateral section is viewed from thereabove at the thin protrusion sections 24 of the joining connector 1 in the connector fitting direction. In addition, FIG. 10 is a partially enlarged view of FIG. 9, and shows a portion near the left end side of the joining terminals 40.

When the board connectors 2 and 3 are disposed being displaced relative to each other from the regular positions in the terminal arrangement direction, first prior to the connector fitting, the first support member 20 and the second support member 30 of the joining connector 1 are relatively moved to positions that follow the positions of the board connectors 2 and 3 in the terminal arrangement direction. As a result of this relative movement, as shown in FIG. 9, the joining terminal 40 is in a state of tilting to the joining direction (the left-and-right direction in FIG. 9) in the terminal arrangement direction (the up-and-down direction in FIG. 9).

In the state that the joining terminal 40 is moved as described above, the extending section 42 of the joining terminal 40 is in a tilted state being moved within range of the gap formed between the plate surface of the extending section 42 and inner wall surfaces of the hole of the support section 25 in the terminal arrangement direction, as shown in FIG. 9. Similarly, even in the hole of the support section 34 of the second support member 30, the extending section 42 is in tilted state. The movement of the extending section 42 does not cause any elastic deformation of the joining terminal 40.

In the embodiment, each protrusion to be supported 42A of the joining terminal 40 is formed as a protrusion, and is supported by almost point contact with the support sections 25 and 34 so that the support area is small. Therefore, upon movement of the joining terminal 40, since the friction between the protrusion to be supported 42A and the support sections 25 and 34 is small, the joining terminal 40 can smoothly move and can smoothly respond to the displacement of the board connectors 2 and 3.

In addition, when the support members 20 and 30 are moved relative to each other in the terminal arrangement direction, the latching protrusion 24A of the first support member 20 can move within the gap formed with the edge of the latching hole 32B-1 of the second support member 30 in the terminal arrangement direction. Furthermore, since the latching protrusions 24A contact with the edges of the latching holes 32B-1 in the terminal arrangement direction, the latching protrusions 24A are restricted from moving in the direction more than a specific amount.

Moreover, as well shown in FIG. 4, the upper groove 32C-1 and the lower groove 32C-2 formed on the side wall 32C of the second support member 30 are formed to penetrate in the terminal arrangement direction (a direction vertical to the paper surface in FIG. 4). Accordingly, when the support members 20 and 30 relatively move, the flat section 21 and the projecting flat sections 23A of the first support member 20, which are housed in the upper groove 32C-1 and the lower groove 32C-2, respectively, can move along the terminal arrangement direction as staying in the upper groove 32C-1 and the lower groove 32C-2.

As described above, in the embodiment, by the gap of the support member 25 and 34, the gap between the latching protrusion 24A and the latching hole 32B-1, and the upper groove 32C-1 and the lower groove 32C-2 that penetrate in the terminal arrangement direction, the support members 20 and 30 can relatively move and following this movement, the joining terminal 40 can move.

Therefore, when the support members 20 and 30 and the joining terminals 40 move responding to the displacement of the board connectors 2 and 3 relative to each other, there is no external force that causes elastic deformation of the support members 20 and 30 and the joining terminals 40 in the terminal arrangement direction. Accordingly, since the joining terminals 40 would not be elastically deformed, it is possible to prevent damages of the support members 20 and 30 and the joining terminals 40. Moreover, since there is no reaction force from the external force, it is possible to move the support members 20 and 30 and the joining terminals 40 with small resistance.

Furthermore, in the embodiment, since the mating terminals 60 and 80 of the board connectors 2 and 3 contact by point contact at the mating contact protrusions 61A and 81A to the plate surfaces of the contact sections 41A of the joining terminals 40, the friction generated at the contacts is small for the smallness of the contact area. Accordingly, it is possible to smoothly move the joining terminals 40 and the support members 20 and 30.

Next, while keeping the relatively moved state of the first support member 20 and the second support member 30, the joining connector 1 is fitted into the board connectors 2 and 3 from thereabove. Since the contact between the terminals and latching between the housings upon fitting are similar to the case when the support members 20 and 30 are at the regular positions, the explanation is omitted.

In the above description, the case where the board connectors 2 and 3 are displaced in the terminal arrangement direction, but it is possible to apply the joining connector 1 of the embodiment even in a case that the board connectors 2 and 3 are displaced from the regular positions in the joining direction and the connector fitting direction.

In the embodiment, the mating contact protrusions 61A of mating terminals 60 contact to the plate surfaces of the contact sections 41A of the joining terminals 40, which extend in the joining direction and the connector fitting direction. Accordingly, even if the board connectors 2 and 3 are displaced in the joining direction and the connector fitting direction, it is possible to contact the contact sections 41A with the mating contact protrusions as long as the displacement is within range that the mating contact protrusions 61A are within range of the plate surface of the contact section 41A, and it is possible to secure the state of the electrical connection between the joining connector 1 and the board connectors 2 and 3.

Figure 11:
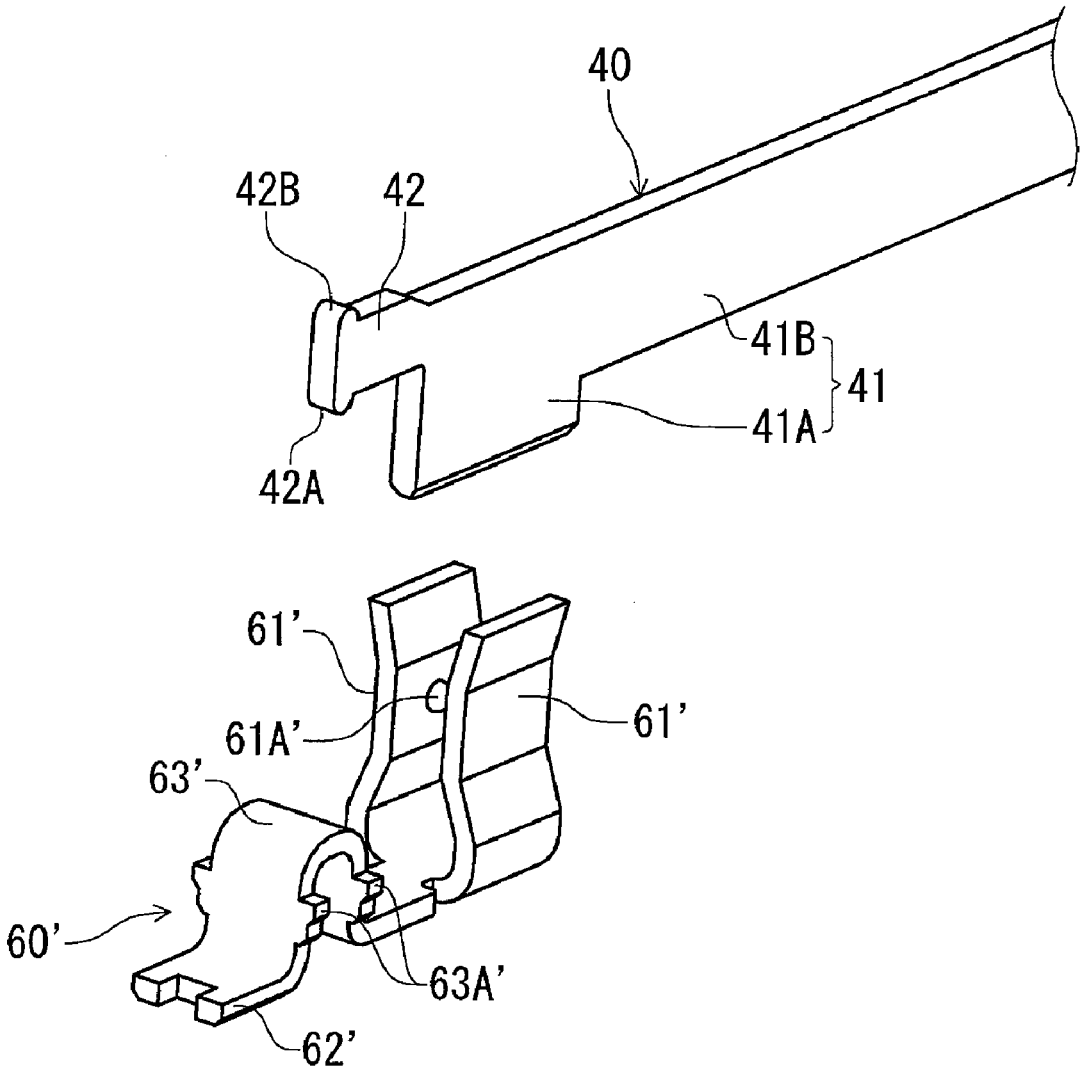
FIG. 11 is a perspective view showing a modification example of the terminal of the board electrical connector according to the first embodiment of the present invention.

FIG. 11 is a perspective view of a modification example of the mating terminal of the board connector in the embodiment. In the modification example, the mating terminal is different from the mating terminal of the aforementioned embodiment in which the side surfaces of the pair of mating contact arms face to each other, since the pair of the mating contact arms of the mating terminal is formed to have a shape so that the plate surfaces face to each other. Here, the shape of the joining terminals is the same as that of the joining terminals in the aforementioned embodiment.

As shown in FIG. 11, on the surface facing the mating contact arm 61' of the mating terminal 60', a mating contact protrusion 61A' that protrudes so as to get close thereto is formed, for example, by embossing. The distance between the pair of the mating contact protrusions 61A' is slightly smaller than the plate thickness of the joining terminal 40. In the connector fitting state, the pair of mating contact protrusions 61A' tightly presses the contact section 41A of the joining terminal 40 by the plate surface, and the pair of mating contact protrusions 61A' elastically contact thereto. In the modification example, the contact section 41A and the mating contact protrusion 61A' contact to each other by point contact, and because of the small contact area, friction at the contact generated upon moving the joining terminal 40 in the terminal arrangement direction is small and therefore the joining terminal 40 can smoothly move.

There may be various alterations and modifications for the positions of the supported section and the restricting section. For example, it is possible to provide the supported section at a lower edge of the extending section and the restriction on the upper edge of the joining section. In addition, it is also possible to provide the supported section on the lower edge of the joining section and the restricting section on the upper edge of the extending section. In such case of providing the supported section on the lower edge of the joining section, the lower wall 32B of the second support member 30 works as a support section to support the supported section from therebelow.

It is possible to alter and modify the embodiment of the joining terminals 40 of joining connector 1 of the first embodiment in various manners. Hereunder, the joining terminals in embodiments that are different from the first embodiment will be described as a second embodiment to a fourth embodiment.

Second Embodiment

Figure 12:
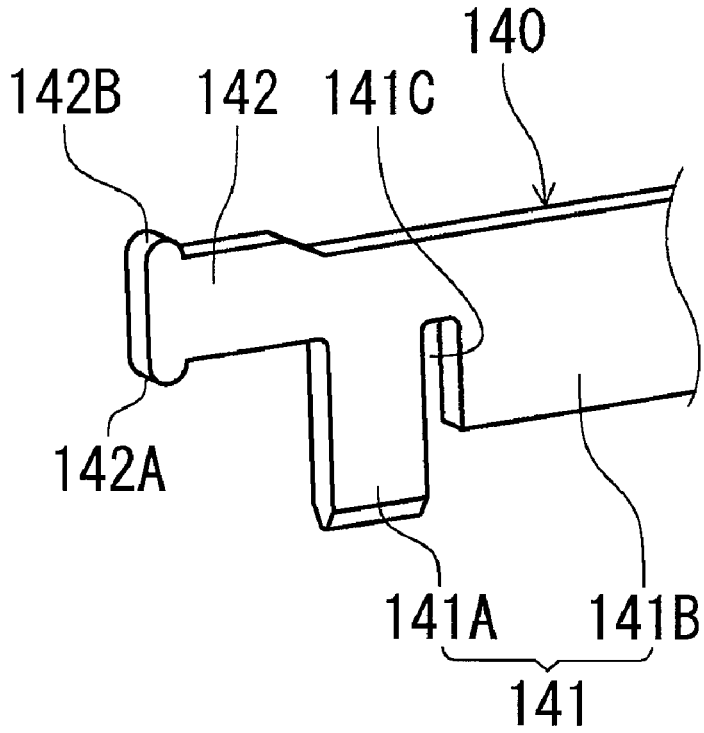
FIG. 12 is a perspective view showing a joining terminal of a joining electrical connector according to a second embodiment of the present invention.

FIG. 12 is a perspective view of a part of the joining terminal in the second embodiment. In the figure, parts that correspond to those in the first embodiment are indicated with reference numerals that are the numerals in the first embodiment plus "100". The joining terminals 140 in the embodiment are different from the joining terminals 40 in the first embodiment, since there is a slit-like groove 141C formed to extend in the connector fitting direction between the contact section 141A and the joining section 141B, while there is no such groove formed and the joining section 41B is continuous to the contact section 41A over the whole range in the connector fitting direction in the first embodiment.

Third Embodiment

Figure 13:
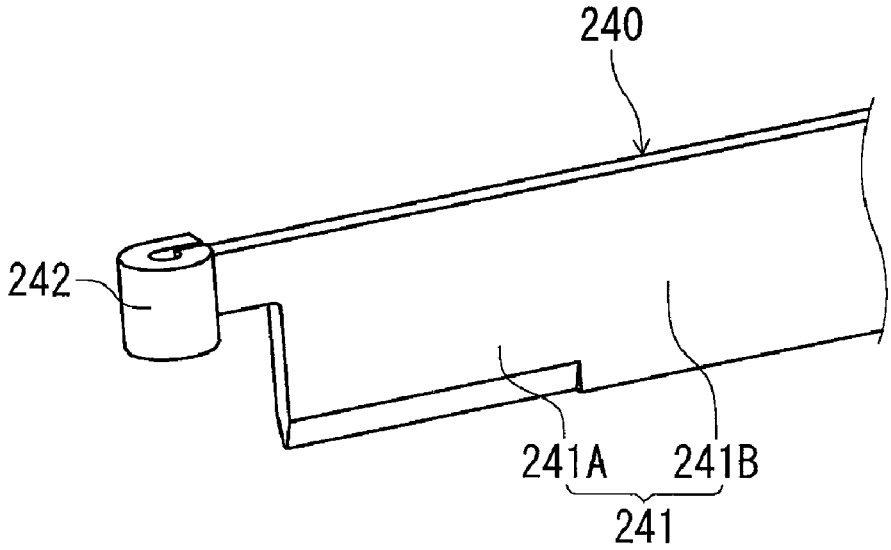
FIG. 13 is a perspective view showing a joining terminal of a joining electrical connector according to a third embodiment of the present invention.

FIG. 13 is a perspective view of a part of the joining terminal in the third embodiment. In the figure, parts that correspond to those in the first embodiment are indicated with reference numerals that are the numerals in the first embodiment plus "200". The joining terminals 240 in the embodiment are different from the joining terminals 40 in the first embodiment, since the extending section 242 is rolled so as to curl in the plate thickness direction, while the extending section 42 is formed to be a flat plate. In addition, the joining terminals 240 are different from the joining terminals 40 in the first embodiment since the lower end surface of each extending section 242 is flat, while there is the protrusion to be supported 42A formed to protrude from a lower end of each extending section 42.

The joining terminal 240 is supported by a support section (not illustrated) of the housing at a flat lower end surface of the extending section 242.

Fourth Embodiment

Figure 14:
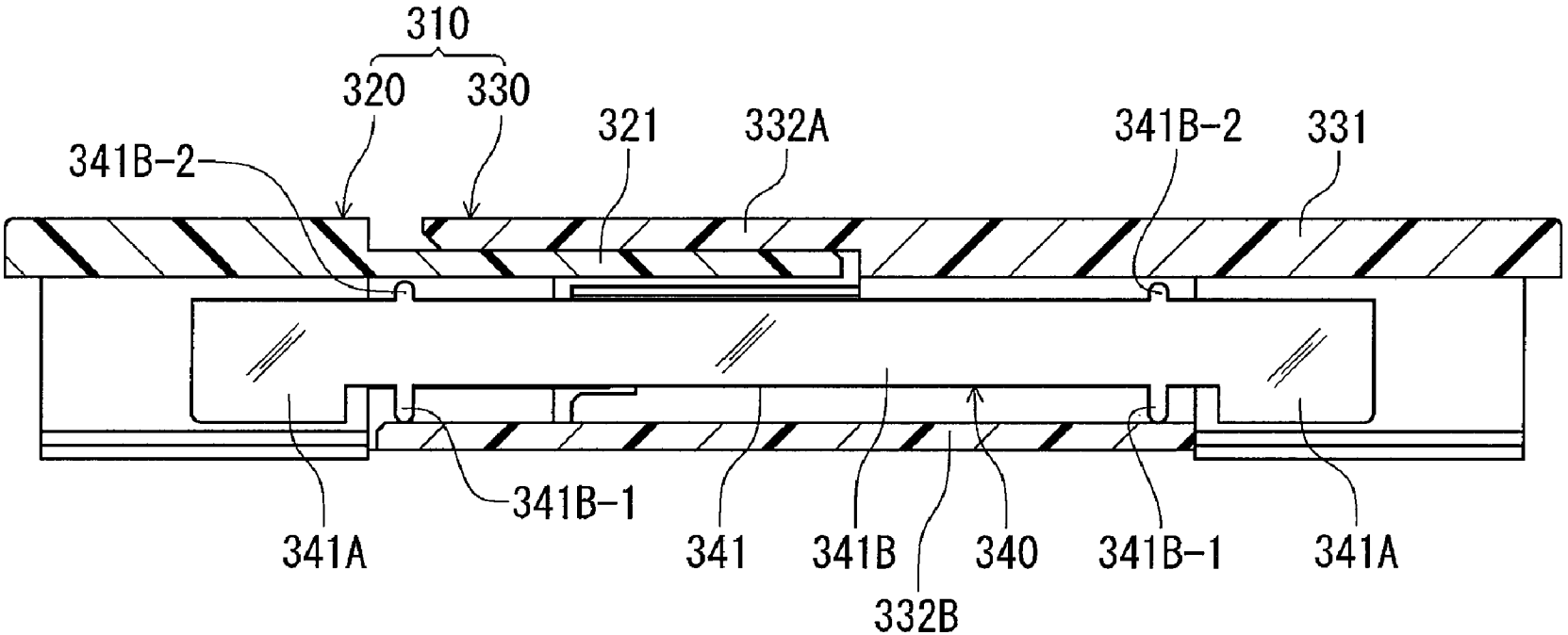
FIG. 14 is a longitudinal sectional view showing a joining electrical connector according to a fourth embodiment of the present invention.

FIG. 14 is a perspective view of a part of the joining terminal in the fourth embodiment. In the figure, parts that correspond to those in the first embodiment are indicated with reference numerals that are the numerals in the first embodiment plus "300". The joining terminals 340 in the embodiment are different from the joining terminals 40 of the first embodiment, since the joining terminal 340 does not have an extending section, but the joining section 341 has the protrusion to be supported 341B-1 and restricting protrusion 341B-2 formed thereon, while the joining terminal has extending section 42 and the extending section 42 has the protrusion to be supported 42A and the restricting protrusion 42B formed thereon.

The joining section 341B has the protrusion to be supported 341B-1 formed to protrude downward from a lower end near the contact section 341A, and the protrusion to be supported 341-B is supported by the lower wall 332B of the housing. In addition, the restricting protrusion 341B-2 protrudes upward from an upper end of the joining section 341B at the same position as that of the protrusion to be supported 341B-1 in the joining direction (a left-and-right direction in FIG. 14), and can contact with the flat sections 21 and 31 of the support members 20 and 30 in the connector fitting direction.

In the embodiment, the joining terminal does not have the extending section and the joining section has the protrusion to be supported and the restricting protrusion. Instead, it is also possible to configure an embodiment that is a combination of the embodiment and the first embodiment. More specifically, it is possible to form the protrusion to be supported and the restricting protrusion having the same shapes as those is the embodiment on the joining section 41B of the joining terminal 40 in the first embodiment.

The disclosure of Japanese Patent Application No. 2010-101915, filed on Apr. 27, 2010 is incorporated in the application by reference.

While the invention has been explained with reference to the specific embodiments of the invention, the explanation is illustrative and the invention is limited only by the appended claims.

What is claimed is:

1. A joining electrical connector to be connected to two board electrical connectors in an insertion direction for joining the two board electrical connectors in a joining direction, comprising:

a housing; and a plurality of joining terminals arranged in the housing in an arrangement direction perpendicular to the insertion direction and the joining direction, each of said joining terminals including a main body portion having an upper edge portion and a lower edge portion in the insertion direction, a contact portion for contacting with a terminal of the board electrical connector, and a supported portion supported on the housing to be slidable in the arrangement direction.

2. The joining electrical connector according to claim 1, wherein said supported portion is situated between the upper edge portion and the lower edge portion in the insertion direction.

3. The joining electrical connector according to claim 1, wherein said supported portion is arranged to protrude in the insertion direction so that the supported portion abuts against the housing in the insertion direction.

4. The joining electrical connector according to claim 1, wherein said main body portion includes an extending portion extending in the joining direction, said supported portion being disposed on the extending portion.

5. The joining electrical connector according to claim 4, wherein said housing includes a hole portion for accommodating the extending portion so that the supported portion is supported on an inner surface of the hole portion.

6. The joining electrical connector according to claim 1, wherein said housing includes a first supporting portion and a second supporting portion, one of said first supporting portion and said second supporting portion including an engaging protrusion, the other of said first supporting portion and said second supporting portion including an engaging hole portion for engaging the engaging protrusion so that the first supporting portion is joined to the second supporting portion in the joining direction and the first supporting portion is slidable relative to the second supporting portion in the arrangement direction.

7. The joining electrical connector according to claim 6, wherein said supported portion includes a first supported portion supported on the first supporting portion and a second supported portion supported on the second supporting portion, said first supported portion being disposed on one end portion of the main body portion in the joining direction, said second supported portion being disposed on the other end portion of the main body portion in the joining direction.

* * * * *